United States Patent [19]

Sadler et al.

[11] Patent Number: 4,833,736

[45] Date of Patent: May 30, 1989

[54] SEATING ASSIST APPARATUS

[76] Inventors: Edward D. Sadler, 304 S. 7th St.; Archie J. Thorp, 300 S. 7th St., both of Davis, Okla. 73030

[21] Appl. No.: 122,251

[22] Filed: Nov. 17, 1987

[51] Int. Cl.[4] ..... A47K 13/10

[52] U.S. Cl. ..... 4/251; 4/254

[58] Field of Search ..... 4/251, 254, 237, 239; 297/DIG. 10

[56] References Cited

U.S. PATENT DOCUMENTS

| | | | |
|---|---|---|---|
| 974,769 | 11/1910 | Hoff | 297/DIG. 10 |
| 3,091,426 | 5/1963 | Bogart | 297/DIG. 10 |
| 3,458,872 | 8/1969 | Hellstrom et al. | 297/DIG. 10 |
| 3,473,174 | 10/1969 | Cool | 297/DIG. 10 |
| 3,925,833 | 12/1975 | Hunter | 4/251 |
| 4,031,576 | 6/1977 | Epstein | 4/251 |
| 4,168,552 | 9/1979 | Austin | 4/237 |
| 4,185,335 | 1/1980 | Alvis | 4/251 |
| 4,587,678 | 5/1986 | Love et al. | 4/251 |

FOREIGN PATENT DOCUMENTS

| | | | |
|---|---|---|---|
| 0057543 | 8/1982 | European Pat. Off. | 4/251 |

*Primary Examiner*—Charles E. Phillips

*Attorney, Agent, or Firm*—Laney, Dougherty, Hessin & Beavers

[57] ABSTRACT

A seating assist apparatus for assisting one in the use of a seat whereby the seat is movable between a horizontal resting position and a raised and tilted position. The apparatus comprises a mounting plate for mounting the seat thereto, a support member adapted to engage the stationary frame portion, rear and forward seat supporting members pivotally coupling the mounting plate and support member, a lever arm attached to an end of one of the rear and forward seat supporting members, and a device for exerting force on the lever arm to pivot the rear and forward seat supporting members when activated by the user of the apparatus. The upward pivoting of the rear and forward seat supporting members raises the mounting plate and the seat mounted thereon, and the rear and forward seat supporting members are dimensioned so that the rear portion of the mounting plate and seat are elevated to a greater extent than the forward portion of the mounting plate and seat.

3 Claims, 3 Drawing Sheets

SEATING ASSIST APPARATUS

BACKGROUND OF THE INVENTION

This invention relates generally to apparatus for assisting one in the use of a seat and more particularly, but not by way of limitation, to apparatus for assisting one in the use of a toilet seat.

Such apparatus have particular utility for persons whose movements are hampered and made difficult by age, illness, incapacitation, or handicap. These persons frequently find it difficult, if not impossible, to be seated and arise from a seat without assistance from someone more able-bodied. Where the seat in question is a recliner, or a chair at a dining room table, the consequences of dependence on others are a loss of self-esteem and the wages of a helper or a nurse. When the seat in question is a toilet seat, feelings of embarrassment and degradation, as well as diminished dignity and privacy are added as costs. There is, then, a significant need for apparatus that enable the user with limited mobility to become more independent.

A patent issued to Love, et al., U.S. Pat. No. 4,587,678, discloses a boosting device for pivotally moving a seat frame assembly relative to a stationary frame. The seat frame assembly contains a transverse member which doubles as a brace for a stationary framework, and which is located underneath the forward portion of a toilet seat which has been mounted on the seat frame assembly. The transverse member has pivot pins at its ends, with such pins being placed in upright members of the stationary framework, thereby enabling the rotation of the seat frame assembly and toilet seat about this transverse member. Rotation is actuated by the application of force to a lever arm extending from the transverse member.

A patent to Austin, U.S. Pat. No. 4,168,552, discloses a mechanically adjustable toilet seat employing screw jacks on either side of the seat. The seat is securely held in the horizontal position by a mounting plate. A reversible electric motor actuates the raising or lowering of the seat by means of the screw jacks and a system of belts and pulleys interconnecting the rotary drive shafts of the two jacks, such motor in turn being activated and controlled by the user so that the height of the seat may be adjusted and controlled. A patent to Hunter, U.S. Pat. No. 3,925,833, discloses a device employing hydraulic means instead of electrical means for raising and lowering a toilet seat which has been fixed in horizontal position by attachment to a frame.

A patent to Epstein, U.S. Pat. No. 4,031,576, discloses a toilet seat which is hinged at the back of the seat to a seat assembly employing a vertical slotted member. The vertical slotted member guides the upward and downward movement of the seat, which swings into a substantially vertical position when the user manually activates a lever and rises with the support of arm rests included in the seat assembly. The seat remains in a vertical position during descent of the seat assembly until the front edge of the seat contacts the edge of the commode, at which point the user may begin tranferring his weight from the arm rests to the seat itself for support.

As shown by the above-mentioned disclosures, there is a need for an apparatus that permits a seat to be raised or lowered at the user's convenience. None of these disclosures, however, provides also for simultaneously raising and tilting the entire seat to an upper position where the user can conveniently settle onto or lift off of the seat. Such a feature would minimize stresses on the user's knees and legs in safely attaining a seated position from a standing position, and would provide support, by virtue of its tilting feature, along the user's thighs as the user was raised from, and lowered to, a seated position. A design employing this feature could permit a user to simply pivot his body into position for lowering to, and rising from, a seated position, with a minimum of bending at the knee and with a minimum of reliance on the user's arms to support the user, once the user is pivoted into position on the seat.

SUMMARY OF THE INVENTION

The present invention overcomes the above-noted and other shortcomings of the prior art by providing a novel and improved seating assist apparatus which permits the movement of a seat from a resting position to a raised position, wherein the entire seat is both raised and tilted with respect to a stationary frame portion with which the seat is adapted to be used.

In a preferred embodiment, the present invention provides a toilet seating assist apparatus for assisting one in the use of a toilet having a basin and a rim around the basin. This embodiment of the seating assist apparatus comprises: receiving means, having forward and rear portions, for receiving a user of the apparatus; and, raising means for raising and tilting the receiving means relative to the rim of the toilet basin so that both the forward and rear portions of the receiving means are raised from a resting position relative to the rim of the toilet basin to a raised position wherein the rear portion of the receiving means is raised to a greater extent than the forward portion of the receiving means.

In the more general embodiment of a seating assist apparatus for assisting one in the use of a seat adapted to be disposed on a stationary frame portion, the apparatus comprises: mounting means, having forward and rear portions, for mounting the seat to the apparatus; means for engaging the stationary frame portion; rear connector means for pivotally coupling the rear portion of the mounting means and the means for engaging the stationary frame portion; forward connector means for pivotally coupling the forward portion of the mounting means and the means for engaging the stationary frame portion; and actuating means for pivoting the rear connector means and the forward connector means with respect to the stationary frame portion.

Therefore, from the foregoing, it is a general object of the present invention to provide a novel and improved seating assist apparatus Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
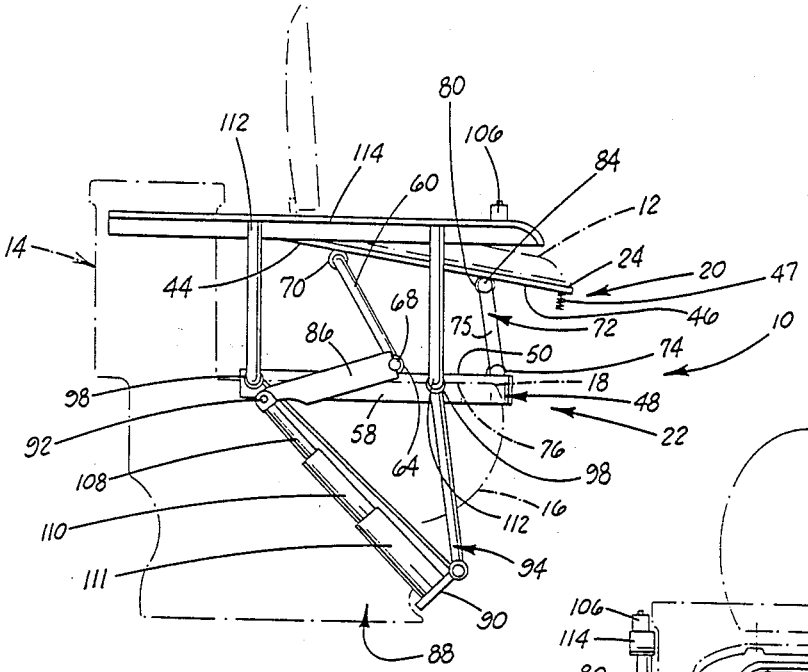
FIG. 1 is a side elevational view of a preferred embodiment of the present invention, with mounting means and seat in a raised position.

Referring now to the drawings, and more particularly to FIGS. 1–6, the seating assist apparatus of the present invention is shown and generally designated by the numeral 10. In the preferred embodiment shown, such seating assist apparatus 10 is adapted for assisting one in the use of a toilet seat 12 of a toilet 14 having a basin 16 and a rim 18 (see FIG. 9) around the basin 16. This apparatus broadly comprises: receiving means (generally designated 20) for receiving a user of the toilet 14; and raising means (generally designated 22) for raising and tilting the receiving means 20 (particularly with respect to the rim 18 when the apparatus 10 is mounted on the toilet 14).

Figure 2:
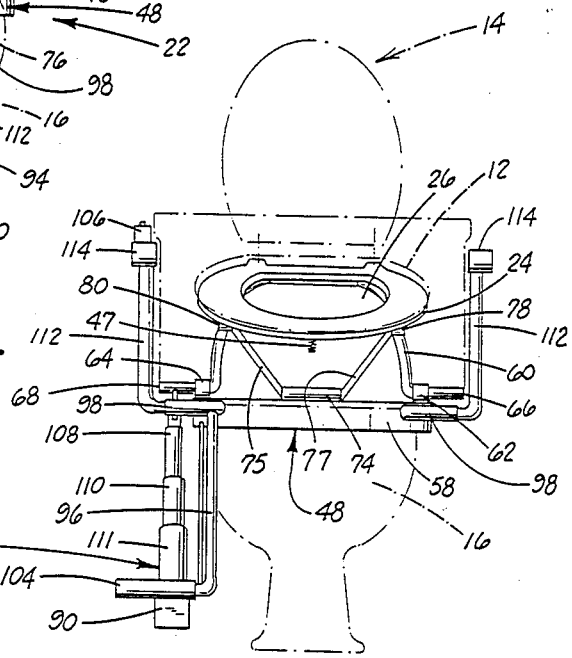
FIG. 2 is a front elevational view of the same preferred embodiment of the present invention, again with mounting means and seat in a raised position.
Figure 3:
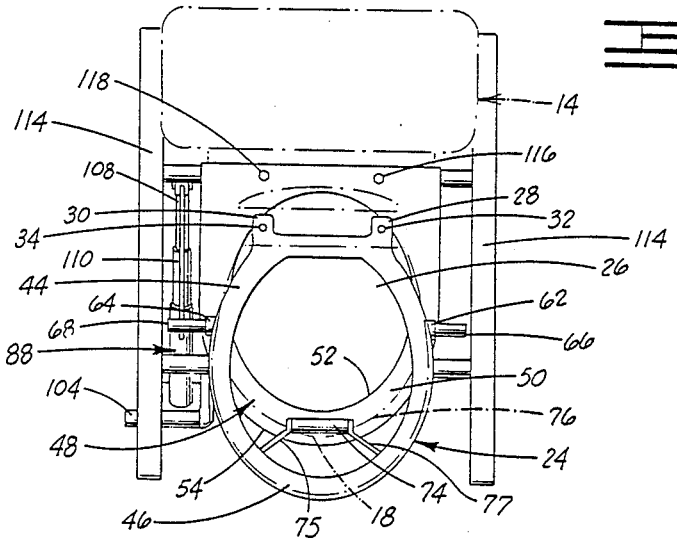
FIG. 3 is a plan view of the preferred embodiment positioned as in FIGS. 1 and 2.
Figure 4:
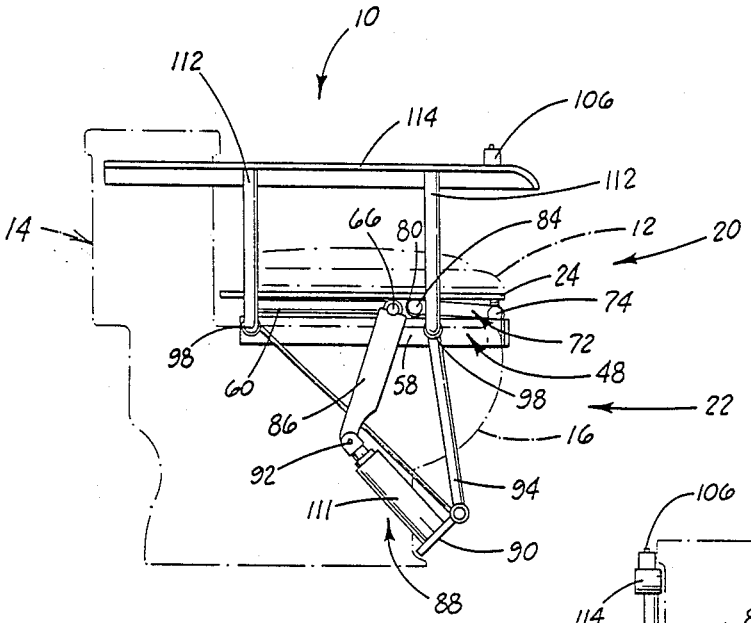
FIG. 4 is a side elevational view of the preferred embodiment of the present invention, with mounting means and seat in a lowered position.
Figure 6:
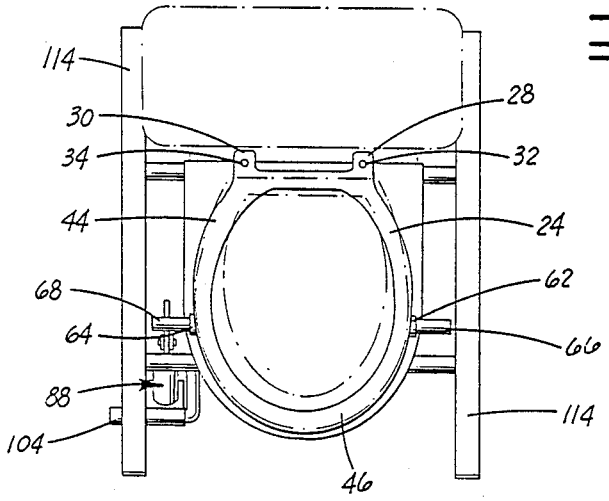
FIG. 6 is a plan view of the preferred embodiment positioned as in FIGS. 4 and 5.
Figure 7:
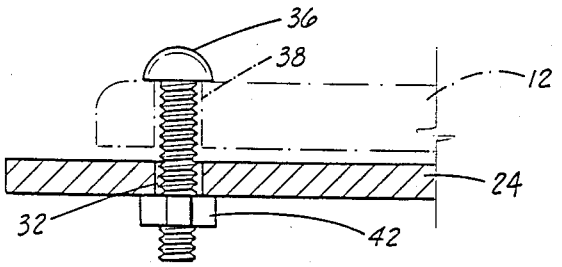
FIG. 7 is a side sectional view on an enlarged scale of a portion of the toilet seat and mounting plate showing the connection therebetween.

The receiving means 20 of the present invention includes mounting means such as a generally oval-shaped mounting plate 24 of the preferred embodiment having a generally oval-shaped hole 26 defined therein (see FIGS. 2 and 3, for example). The mounting plate 24 has ear-like appendages 28 and 30 with holes 32 and 34, respectively, defined therein for receiving a respective bolt 36 passing through a corresponding hole 38 in the toilet seat 12 (see FIG. 7). The toilet seat 12 may therefore be mounted on the mounting plate 24 by aligning holes 32 and 34 with the respective hole 38, passing the respective bolt 36 through a respective set of the aligned holes, and securing each bolt with a respective nut 42. As indicated in FIGS. 1 and 6, for example, the mounting plate 24 of the preferred embodiment has both a rear portion 44 and a forward portion 46, the rear portion 44 shown in FIG. 1 as having been raised to a greater extent than the forward portion 46 to illustrate the tilting feature of the present invention. A coiled spring 47 is attached to the underside of the forward portion 46 to provide a cushioning force when the plate 24 is lowered against the raising means 22.

The raising means 22 of the present invention includes support means for supporting the receiving means. The raising means 22 also includes rear connector means and forward connector means, both for connecting the receiving means and the support means. The support means includes means for engaging the stationary frame portion with which the seat to be moved by the present invention is to be used (i.e., the basin 16 to which the seat 12 is normally connected when the present invention is not used) Such means for engaging the stationary frame portion includes in the illustrated preferred embodiment (see FIG. 9 in particular) a generally oval-shaped rimming member 48 comprising: a support member 50, having an inner edge 52 and an outer edge 54; an inner lining member 56 extending downwardly (particularly with respect to the toilet basin 16) at the inner edge 52 of the support member 50; and an outer surrounding member 58 extending downwardly at the outer edge 54 of the support member 50 to surround substantially the rim 18 of the basin 16.

The rear connector means of the present invention includes a rear seat supporting member, shown in the preferred embodiment as an arcuate rod 60 of cylindrical cross-section.

The rear connector means also includes rear support pivot means for pivotally coupling the rear seat supporting member (rod 60) and the support means (rimming member 48). In the preferred embodiment the rear support pivot means includes cylindrical collars 62 and 64 connected to the support member 50 on opposite sides thereof near the middle of the member 50 as measured from front to back relative to how it is to be positioned on the rim 18 of the basin 16. Ends 66 and 68 of the arcuate rod 60 pass through the cylindrical collars 62 and 64, so that the arcuate rod 60 pivots with respect to the rimming member 48 at the cylindrical collars 62 and 64.

The rear connector means further includes rear seat pivot means for pivotally coupling the rear seat supporting member (rod 60) and the receiving means (plate 24). The rear seat pivot means of the preferred embodiment includes a cylindrical collar 70, located underneath and adjacent the rear portion 44 of the mounting plate 24, through which the arcuate rod 60 passes and is pivotally retained adjacent the mounting plate 24.

Figure 5:
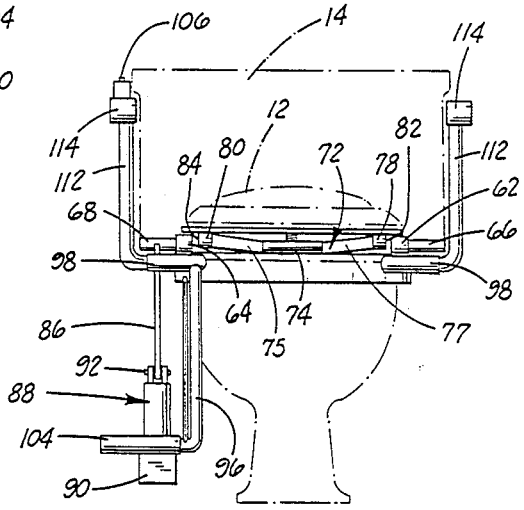
FIG. 5 is a front elevational view of the same preferred embodiment, again with mounting means and seat in a lowered position.
Figure 9:
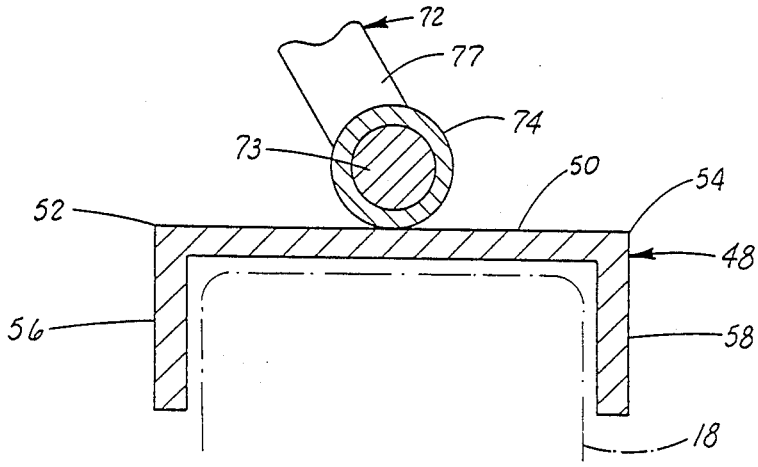
FIG. 9 is a cross-sectional view on an enlarged scale of the front portion of the rimming member of the preferred embodiment illustrated as mounted on the rim of a toilet basin.

The forward connector means includes a forward seat supporting member shown in the preferred embodiment as a generally V-shaped strut 72 having a cylindrical middle portion 73 from which arms 75, 77 extend. The forward connector means also includes forward support pivot means for pivotally coupling the forward seat supporting member (strut 72) and the support means (rimming member 48), and forward seat pivot means for pivotally coupling the forward seat supporting member (strut 72) and the receiving means (plate 24). The forward support pivot means of the preferred embodiment includes a cylindrical collar 74 connected to the rimming member 48 at its forwardmost portion. As best shown in FIG. 9, the collar 74 receives the middle portion 73 of the strut 72. The forward seat pivot means includes in the preferred embodiment cylindrical collars 78 and 80 connected underneath and adjacent the forward portion 46 of the mounting plate 24 as best illustrated in FIG. 5. Ends 82 and 84 of the strut 72 extend through the collars 78 and 80, respectively.

To mechanically operate the receiving means 20 and the raising means 22, the apparatus of the present invention further comprises actuating means for pivoting the rear seat supporting member and the forward seat supporting member relative to the support means. In the preferred embodiment shown, the actuating means includes a lever arm attached to at least one of the rear seat supporting or forward seat supporting members; as illustrated, the actuating means includes a lever arm 86 having one end securely attached to the end 66 of the arcuate rod 60. The lever arm 86 has another end pivotally connected by virtue of a pivot pin 92 to a hydraulic cylinder 88 having a base 90. The base 90 of the hydraulic cylinder 88 is connected to a cylindrical cylinder bracing member 94. The cylinder bracing member 94 has a vertical portion 96 extending downwardly from one of four horizontal extension members 98 (see FIG. 5) which extend horizontally from the outer surrounding member 58 of the rimming member 48, one pair of such members 98 extending outwardly from each of the two opposing sides of the rimming member 48. The cylinder bracing member 94 also has a horizontal portion 104 which abuts against, and connects to the base 90 of the hydraulic cylinder 88.

The cylinder 88 provides drive means for applying force to the lever arm by which the receiving means 20 is moved up and down relative to the rimming member 48 of the raising means 22. This force is applied to the point at which the pivot pin 92 pivotally couples the hydraulic cylinder 88 and the lever arm 86. It is to be noted that a particular advantage of the illustrated activating means is that it utilizes little floor space or other space below the rim 18 of the toilet 14. This advantage is also obtained through the structure of the raising means 22 which is constructed to be supported substantially, and if desired completely, by the toilet 14.

Raising and tilting of the toilet seat 12 mounted on the mounting plate 24 is accomplished by activation of the hydraulic cylinder 88 through manipulation of a conventional hydraulic cylinder control means 106 by the user of the apparatus. Activation of the hydraulic cylinder 88 to raise the toilet seat 12 from a lower, resting horizontal position, shown in FIGS. 4–6, to an upper, raised and tilted position shown in FIGS. 1–3, results in extension of inner cylinder members 108, 110 of the hydraulic cylinder 88 from within an outer cylinder housing member 111, thus causing a pivoting of the lever arm 86 and, in turn, a pivoting of the arcuate rod 60. The pivoting of the arcuate rod 60 forces a pivoting also of the strut 72, and an elevation of both the forward portion 46 and the rear portion 44 of the mounting plate 24. The arcuate rod 60 and the strut 72 are so dimensioned as to elevate the rear portion 44 of the mounting plate 24 to a greater extent than the forward portion 46 of the mounting plate 24, so that a forward tilting of the mounting plate 24 is also accomplished.

Although the preferred embodiment of the drive means has been described as including a hydraulic cylinder, it is contemplated that the drive means can include any suitable power mechanism, such as an electric motor or winch or screw jacks, for example. Likewise, although the preferred embodiment incorporates one cylinder, multiple cylinders or other movement mechanisms could be used. Furthermore, the drive means can be selected according to where it is desired to be located (e.g., behind the toilet or other structure with which the invention is used) so that space requirements can be accommodated.

The apparatus of the present invention can be suitably equipped with a funnel and/or with a curtain (not shown) suspended from the mounting plate 24 to direct wastes into the basin 16 of the toilet 14. Armrests can also be used as illustrated, but they are not necessary should space, or other requirements dictate otherwise; vertical armrest support members 112 extend upwardly from each of the horizontal extension members 98 and support armrest members 114.

Figure 8:
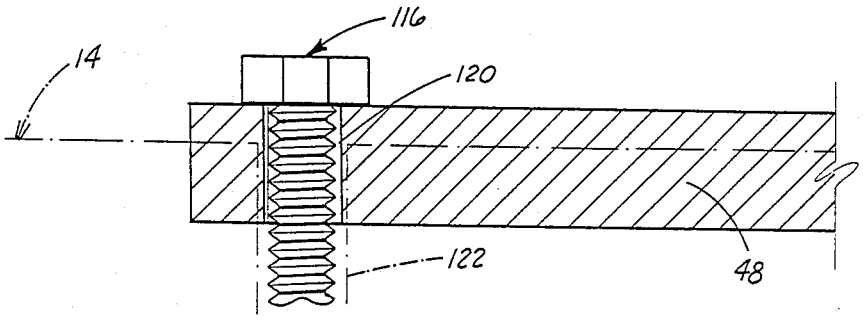
FIG. 8 is a side sectional view on an enlarged scale of a portion of the rimming member and toilet of the preferred embodiment showing the connection therebetween.

The preferred embodiment of the apparatus of the present invention, as shown in FIGS. 1–6, is also equipped with means for securing the rimming member 48 to the toilet 14. This securing means comprises nut and bolt pairs 116 and 118 passed through respective holes 120 defined in the rimming member 48 and aligned respective holes 122 (see FIG. 8) defined in the toilet 14 for normally receiving the conventional toilet seat 12. With this construction of the securing means and with the manner in which the toilet seat 12 is attached to the mounting plate 24, it is apparent that the illustrated embodiment can be installed on a toilet almost as quickly as simply attaching the toilet seat directly to the toilet.

It is further contemplated that the present invention can be specifically made to fit any suitable toilet and can be generally adapted to provide seating assistance onto a seat which would conventionally be disposed on a stationary frame portion capable of supporting the apparatus of the present invention. It is also contemplated that preferable adaptations of the present invention be ones which can be economically constructed and used.

Thus, the present invention, which comfortably assists a person moving between standing and seated positions without requiring much, if any, leg support from the person, is well adapted to carry out the objects and attain the ends and advantages mentioned above as well as those inherent therein. While a preferred embodiment of the invention has been described for the purpose of this disclosure, changes in the construction and arrangement of parts can be made by those skilled in the art, which changes are encompassed within the spirit of this invention, as defined by the appended claims.

What is claimed is:

1. A seating assist apparatus for assisting one in the use of a toilet seat of a toilet having a basin and a rim around the basin, said toilet seating assist apparatus comprising:

a generally oval-shaped mounting plate, having forward and rear portions and further having a generally oval-shaped hole defined therein, for mountably receiving the seat;

a generally oval-shaped rimming member adapted to be disposed adjacent the rim of the toilet basin;

an arcuate rod pivotally coupled between said rear portion of said mounting plate and said rimming member;

a generally V-shaped strut spaced from said arcuate rod and discrete with respect thereto, said strut being further pivotally coupled between said forward portion of said mounting plate and said rimming member;

a lever arm attached to an end of said arcuate rod; and a hydraulic cylinder pivotally connected to said lever arm remote form the attachment of said lever arm and said arcuate rod.

2. An apparatus as defined in claim 1, further comprising:

a pair of horizontal extension members extending substantially perpendicularly and horizontally outward from each of two opposing sides of said rimming member;

a pair of vertical armrest support members extending upwardly from each said pair of horizontal extension members; and an armrest member extending between said pair of vertical armrest support members.

3. An apparatus as defined in claim 1, wherein said rimming member comprises:

a generally oval-shaped support member having an inner edge and an outer edge;

an inner lining member extending downwardly with respect to the rim of the toilet basin at said inner edge of said support member; and an outer surrounding member extending downwardly with respect to the rim of the toilet basin at said outer edge of said support member to closely surround substantially the rim of the toilet basin.

* * * * *